United States Patent [19]

Watkins et al.

[11] Patent Number: 4,975,681

[45] Date of Patent: Dec. 4, 1990

[54] INTERFERING SIGNAL REJECTION CIRCUITRY AND ELECTRONIC ARTICLE SURVEILLANCE SYSTEM AND METHOD EMPLOYING SAME

[75] Inventors: Harry E. Watkins, Boca Raton; Kevin Lynch, Coral Springs, both of Fla.

[73] Assignee: Sensormatic Electronics Corporation, Deerfield Beach, Fla.

[21] Appl. No.: 447,382

[22] Filed: Dec. 7, 1989

[51] Int. Cl.[5] ..... G08B 13/14

[52] U.S. Cl. ..... 340/572; 340/825.72

[58] Field of Search ..... 340/572, 825.72, 310 A, 340/527

[56] References Cited

U.S. PATENT DOCUMENTS 4,260,983 4/1981 Falck et al. ..... 340/572

4,791,412 12/1988 Brooks ..... 340/572

*Primary Examiner*—Joseph A. Orsino

*Assistant Examiner*—Thomas J. Mullen, Jr.

*Attorney, Agent, or Firm*—Robin, Blecker, Daley & Driscoll

[57] ABSTRACT

A control arrangement both interrelates the frequency of transmitted signals to an interfering frequency and effects received signal processing also with relation to the interfering frequency in reaching enhanced insensitivity to undesired content of received signals. In particular respect of interference arising in an EAS system in relation to the local power frequency, the invention looks to a control arrangement which both interrelates the frequency of the transmitted signals to the local power frequency and effects received signal processing with relation to the local power frequency in reaching enhanced insensitivity to undesired content of received signals.

47 Claims, 7 Drawing Sheets

INTERFERING SIGNAL REJECTION CIRCUITRY AND ELECTRONIC ARTICLE SURVEILLANCE SYSTEM AND METHOD EMPLOYING SAME

FIELD OF THE INVENTION

This invention relates generally to the rejection of interfering electrical signals and pertains more particularly to interference signal rejection circuitry for use in electronic article surveillance (EAS) for improved detection of EAS tags or markers in a controlled zone.

BACKGROUND OF THE INVENTION

A known and commercially-implemented EAS system is of a type involving a transmitting antenna and a receiving antenna placed about a controlled zone, such as the exit of a retail establishment. A transmitter furnishes signals to the transmitting antenna for transmission into the controlled zone and is energized from local power, in the United States at sixty Hertz and in Europe at fifty Hertz. While the transmitted signals are at a frequency substantially higher than the local power frequency, high harmonics of the local power frequency, often arising from other equipment in the vicinity of the controlled zone, e.g., cash registers, printers, neon lights, etc., can occur within the detecting frequency band of the receiver of the system. Such detecting frequency band, in the known system under discussion, encompasses the fundamental of the transmission frequency (the system operating frequency) and the second and third harmonics thereof.

EAS tags or markers affixed to articles are adapted, upon receipt of the transmitted signals, to return signals rich in the second harmonic and weak in the third harmonic of the system operating frequency. System alarm activation occurs when the receiver sees a rich second harmonic return in the absence of receipt concurrently of a fundamental frequency change or shift which is less than a predetermined level and of the third harmonic which is less than another predetermined level.

As will be appreciated, where the vicinity of the controlled zone has tag-extraneous presences of high levels of fundamental and/or third harmonic generators, i.e., generally interfering signals, the system may by its conditional logic come not to generate an alarm condition for a tag passing unauthorizedly through the controlled zone. Improved system insensitivity to tag-unrelated generation of such high level fundamental and third harmonic returns in the nature of interfering signals would manifestly improve the effectiveness of such known and other EAS systems.

SUMMARY OF THE INVENTION

The present invention has as its primary object the provision of improved systems and methods for operating electronic apparatus in the face of interfering signals with effective rejection of adverse influence thereof on performance.

A more particular object of the invention is the provision of improved systems and methods for operating EAS apparatus in the face of interfering signals with effective rejection of adverse influence thereof on accurate detection of EAS tags.

A still further particular object of the invention is the provision of EAS systems having enhanced insensitivity to tag-unrelated generation of high level fundamental and third harmonic returns in a controlled zone.

In a quite specific application detailed below, the invention addresses enhanced EAS detection capacity in the face of interference arising in relation to the local power source frequency involved in the energization of the transmitter in the exemplary EAS system above discussed.

In attaining the foregoing and other objects, the invention looks to a control arrangement which both interrelates the frequency of the transmitted signals to the interfering frequency and effects received signal processing also with relation to the interfering frequency in reaching enhanced insensitivity to undesired content of received signals.

In attaining such objects particularly in respect of interference arising in an EAS system in relation to the local power frequency, the invention looks to a control arrangement which both interrelates the frequency of the transmitted signals to the local power frequency and effects received signal processing with relation to the local power frequency in reaching enhanced insensitivity to undesired content of received signals.

As will be explained in detail below, the invention recognizes, in its EAS application, as the source of vast undesired returns, the fundamental and harmonics of the local power frequency, and provides measures both as to controlling the system operating frequency and to processing received signals in relation to local power frequency.

In broad summary, the invention realizes signal processing of received signals in time domain synchronism with the interfering frequency but enforces a frequency domain asynchronism as between the system operating frequency and the interfering frequency.

More specifically, where the application of the invention is in the EAS field and wherein the interfering frequency source of concern is the local power frequency, the invention provides a system for processing signals returned from objects in the vicinity of a controlled zone responsively to incidence thereon of signals transmitted therein at a first frequency by a transmitter supplied with local power at a second frequency. The system comprises first circuitry for receiving such returned signals, delaying the returned signals for a time period, and combining the returned signals and such delayed returned signals to provide signals for processing further by the receiver of such known system. Second circuitry of the system is responsive to identifier signals indicative of the second frequency for establishing both the time period for the first circuitry and the first frequency.

The foregoing and other objects and features of the invention will be further understood from the following detailed description thereof and from the drawings, wherein like components and parts are identified by the same reference numerals.

DETAILED DESCRIPTION OF PREFERRED EMBODIMENTS AND PRACTICES

Figure 1:
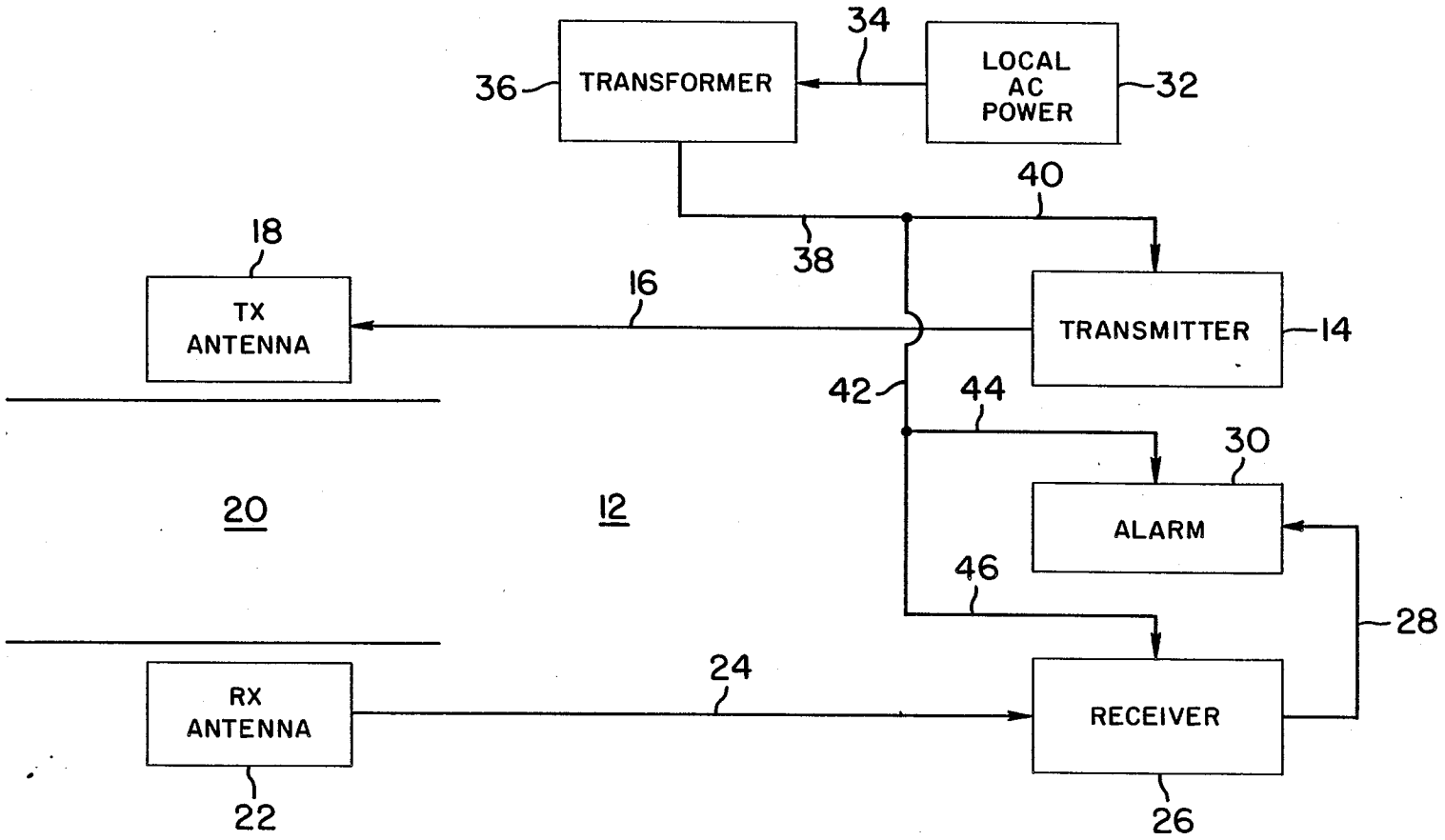
FIG. 1 (PRIOR ART)
FIG. 1 is a block diagram of the known EAS system above generally discussed.

Referring to FIG. 1, the above-noted known system 12 includes transmitter 14, connected over line 16 to transmitting antenna 18 which is disposed in a pedestal bounding a controlled zone 20 in which EAS tags or markers are to be detected.

Receiving antenna 22, likewise disposed in a pedestal and in facing relation to transmitting antenna 18, is connected by line 24 to receiver 26. Upon determining the presence of a tag in zone 20 from processing of received signals, receiver 26 actives line 28, energizing alarm 30.

Local alternating-current (A.C.) power supply 32 feeds power over lines 34 to transformer 36 which then furnishes power to lines 38 and thence over lines 40, 42, 44 and 46 to the system components as indicated.

Figure 2:
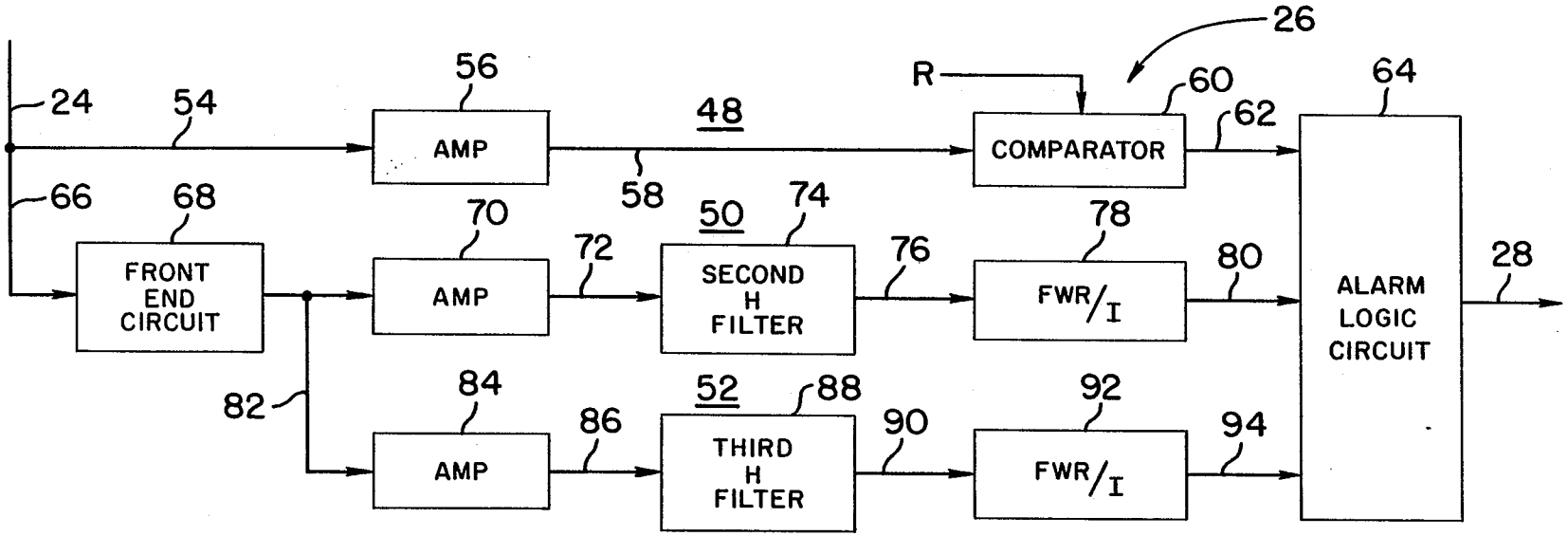
FIG. 2 (PRIOR ART)
FIG. 2 is a block diagram of the receiver of the FIG. 1 system.
Figure 5:
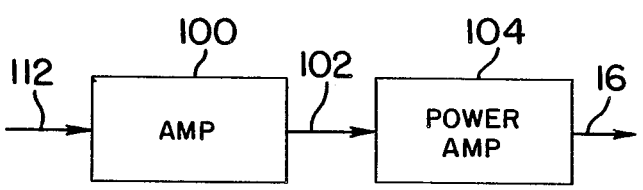
FIG. 5 is a block diagram of the transmitter of the FIG. 4 system.

Turning to FIG. 2, receiver 26 will be seen to have three channels, 48, 50 and 52. Channel 48 processes the system operating frequency fundamental and applies the line 24 received signals over line 54 to variable amplifier 56, the output of which is furnished by line 58 to comparator 60. The comparator has a reference input R and, where the fundamental content of received signals exceeds the level of the reference input, indication is provided over line 62 to alarm logic circuit 64.

Channel 50 processes the second harmonic of the system operating frequency and applies the line 24 received signals over line 66 to receiver front end circuit 68, the output of which is applied to variable amplifier 70. The output of amplifier 70 is fed over line 72 to second harmonic filter 74. Line 76 furnishes second harmonic content of received signals from filter 74 to full-wave rectifier and d.c. integrator (FWR/I) 78. Integrator 78 applies its output over line 80 to alarm logic circuit 64.

Channel 52 processes the third harmonic of the system operating frequency and applies the output of circuit 68 over line 82 to to variable amplifier 84. The output of amplifier 84 is fed over line 86 to third harmonic filter 88. Line 90 furnishes third harmonic content of received signals from filter 88 to full-wave rectifier and D.C. integrator 92. Integrator 92 applies its output over line 94 to alarm logic circuit 64.

Alarm logic circuit 64 activates line 28 to indicate an alarm condition, following the rule above discussed among the fundamental, the second harmonic and the third harmonic inputs thereto.

Figure 3:
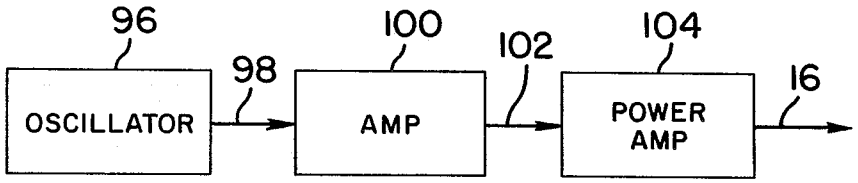
FIG. 3 (PRIOR ART)
FIG. 3 is a block diagram of the transmitter of the FIG. 1 system.

FIG. 3 indicates the structure of transmitter 14 of the FIG. 1 system. Its transmitting frequency is fully established by oscillator 96 whose output on line 98 is amplified by variable amplifier 100 and then furnished over line 102 to power amplifier 104. The power amplifier output is coupled by line 16 directly to the transmitting antenna.

Figure 4:
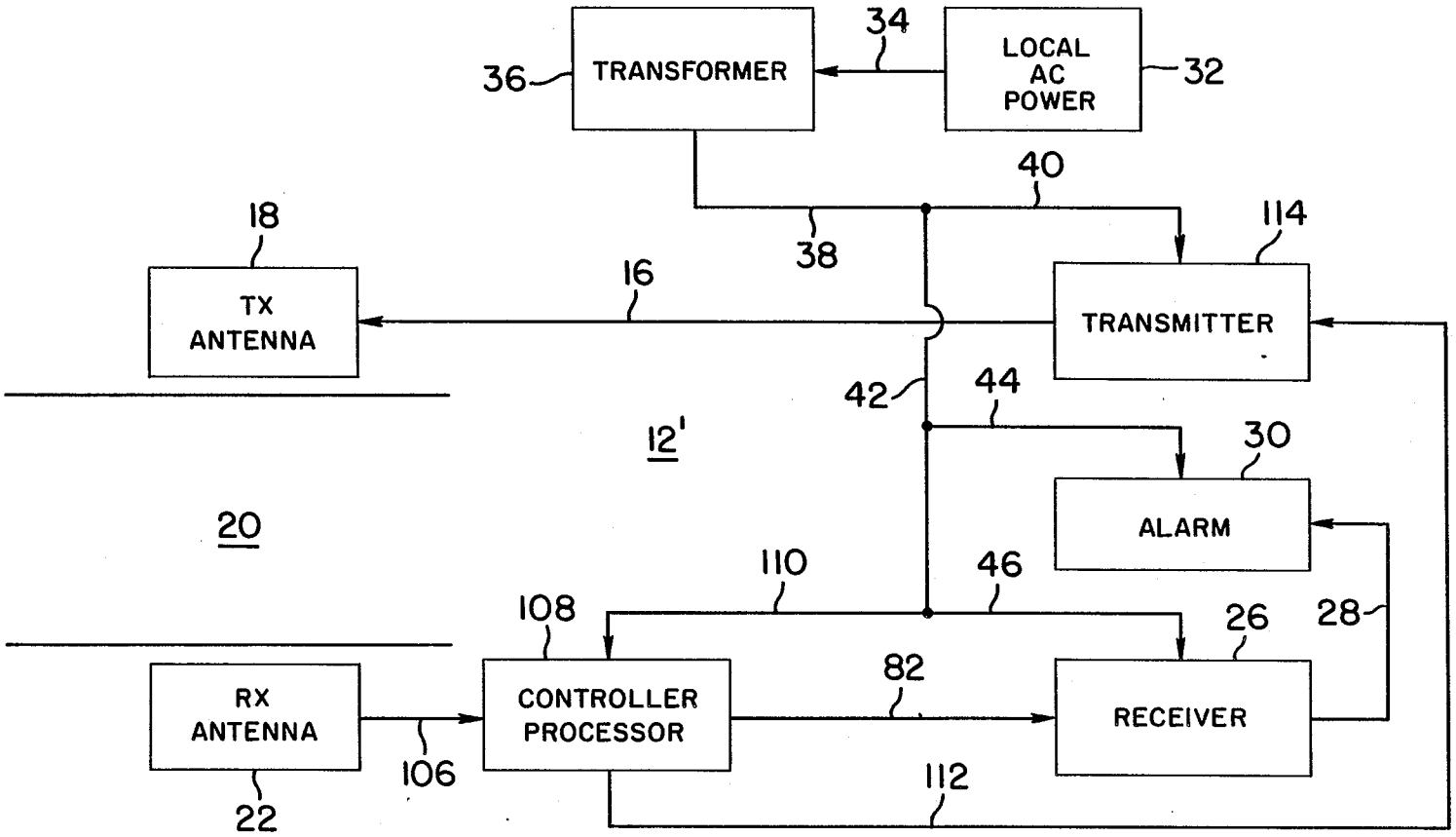
FIG. 4 is a block diagram of an embodiment of the system of the invention.

FIG. 4 redepicts the known system of FIG. 1 and introduces line 106, controller-processor 108, lines 110 and 112 and transmitter 114. The controller-processor receives as its inputs received signals from line 106 and local power with its A.C. frequency indication from line 110. A signal-processed output is provided by the controller-processor over line 82 to receiver 26. A controlled-frequency output is furnished over line 112 to transmitter 114.

Figure 6:
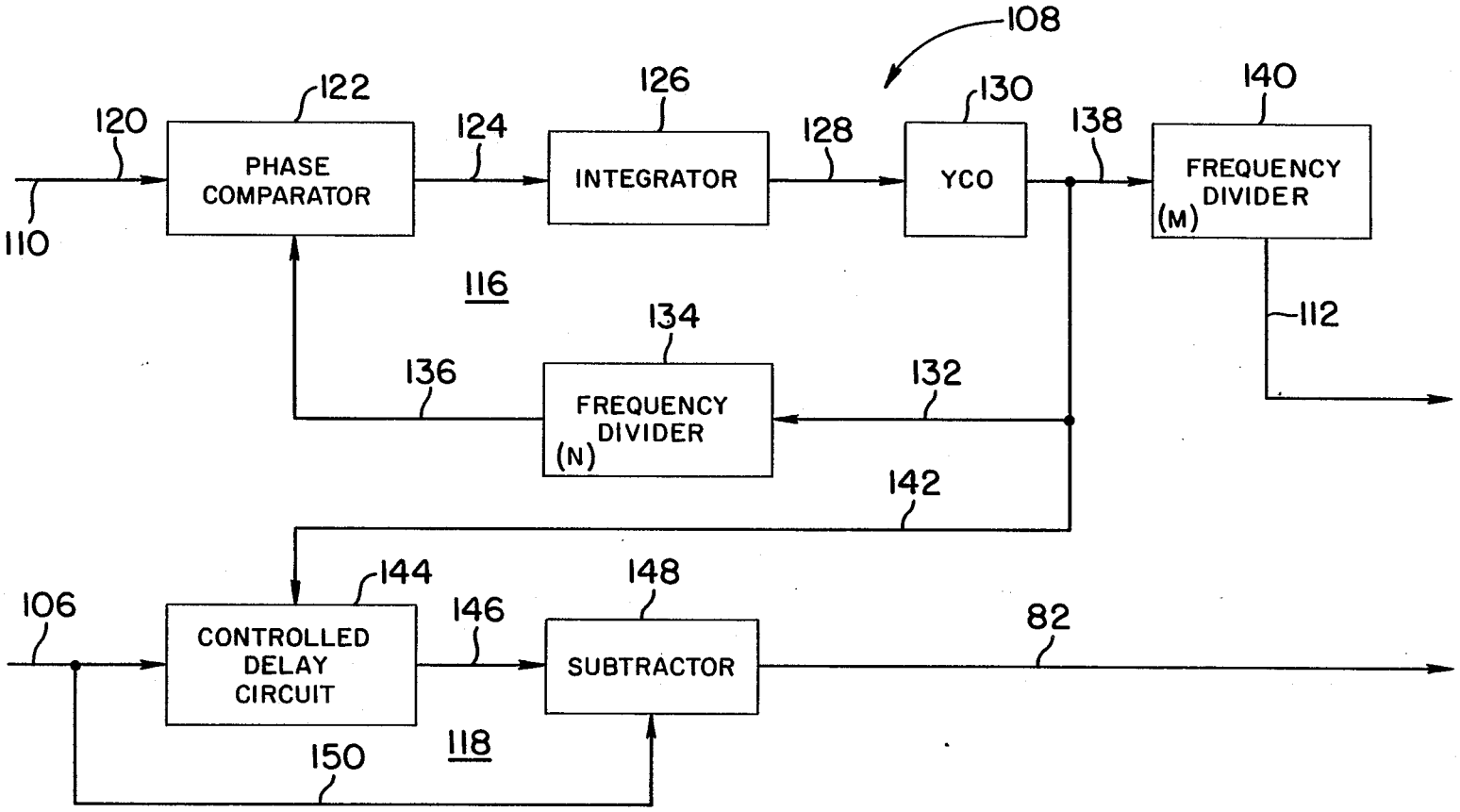
FIG. 6 is a block diagram of the controller-processor of the FIG. 4 system.

The structure of controller-processor 108 is seen in FIG. 6 to have two channels, channel 116 for establishing the system operating frequency and channel 118 for effecting processing of received signals. The input on line 110 is an identifier signal indicative of local power frequency.

By way of background discussion of the functioning of controller-processor 108, certain improvements to the known system have been sought. One is a desire to increase the spacing between the pedestals, which heretofore were unduly closely spaced. This can be achieved by increasing the sizes of the antennas and the power furnished to the transmitting antenna. A concomitant advantage is that the field of view of the antennas could extend below and above that existing heretofore, to encompass floor to full human average height. A further wish is that the known system be improved as respects tolerance to fixed metal in floors, walls and counters of the installation site. Further, enhanced system insensitivity to common retail establishment objects is desired, e.g. cathode-ray tubes, motors, fluorescent lights, neon signs and other electronic equipment.

However, without otherwise modifying the known system, an increase in the size of antennas and increasing energy supplied thereto would give rise to increased content in received signals of third harmonic therein attributable to returns from metal objects. As noted, low level third harmonic is requisite to alarm conditions and the system would inhibit in the face of prevailing high third harmonic. In addition, the receiver would be more susceptible to interference from other noise generators.

The interference from metal is synchronous with the system operating frequency and accordingly cannot be eliminated using conventional filtering techniques. The noise generated from electronic equipment typically has harmonic content related to the local power frequency. These harmonics are often not synchronous with the system operating frequency and can be reduced somewhat using conventional filtering techniques. However, such filtering cannot eliminate the noise when this interference becomes large, as where the electronic noise source is close to the system.

The invention raises a basis for permitting the above antenna size and higher transmitting power improvements, namely, a distinction between the tag signal as a dynamic signal, given the movement of a customer through the controlled zone with the tagged article, and other signals as static signals. Thus, the interference created by stationary metal objects and electronic devices is usually at constant signal levels which do not change with the passage of time. In implementing this basis, the invention includes in controller-processor 108 a first channel for discriminating received signal content as static and for suppressing the same by circuitry analogous to a comb notch filter, wherein the time delay is related to the local power frequency.

The time delay of such filter is synchronized by frequency control, in a second channel of controller-processor 108, so that local power harmonics and system fundamental harmonics which are present for greater than a certain time period are rejected by the filter. In addition, the delay must be long enough so that the tag signals are not rejected by the filter. These conditions are met by synchronizing the system operating frequency to the local power frequency. With this background, discussion is now had of FIG. 6.

Controller-processor channel 116 includes line 120 for applying the local power frequency indication on line 110 to a first input terminal of phase comparator 122. The output of comparator 122 is applied by line 124 to integrator 126, the output of which on line 128 is applied to voltage-controlled oscillator (VCO) 130. The VCO output on line 132 is applied to frequency divider 134 and the divider output on line 136 is applied to a second input of comparator 122. For purposes below discussed, the output of VCO 130 is furnished over line 138 to frequency divider 140 to provide the system operating frequency on line 112.

Assuming the local power frequency to be sixty Hertz and that the desired system operating frequency to be approximately that specified for the known system of FIG. 1, i.e., five hundred and thirty Hertz, divider 134 may have a divider value (N) of nine. That portion of channel 116 to the left of line 138 will be recognized as a phase-locked loop wherein the presence of divider 134 will force an in-phase output from VCO 130 at nine times the local power frequency on line 110.

More particularly, phase comparator 122 provides an error signal which represents the phase difference between the local power frequency and the output of divider 134. This error signal is then integrated to produce a d.c. voltage input to VCO 130. The VCO produces an output signal whose frequency is determined by the d.c. voltage at its input. This output is then divided down by N. The loop locks such that the local power and the output of the divider are at the same frequency. Accordingly, the output of the VCO will be N times the local power frequency.

Turning to channel 118, the comb notch filter thereof has line 142 applying input to controlled delay circuit 144 from VCO 130, and delay circuit 144 also has received signals applied thereto from line 106. Circuit 144 provides delayed received signals on line 146. Subtractor 148 combines received signals without delay, furnished on line 150, with the delayed received signals on line 146 and applies the result to line 82 for further processing in the system receiver.

The time delay in delay circuit 144 is set, per the invention, as an integral multiple of the period of the local power, i.e., of the inverse of the local power frequency. The tag signal is acquired in a quite short time period in relation to the time delay of delay circuit 144 and hence passes freely through channel 118.

A characteristic of the system described to this juncture is that, since the system operating frequency is synchronized to the local power frequency, the second and third harmonic frequencies of the system operating frequency are also synchronized to the local power frequency. For example, if the local power frequency is sixty Hertz (and N=9, M=1), then the system operating frequency fundamental (five hundred and forty Hertz) is the ninth harmonic of the local power frequency, the system operating frequency second harmonic (one thousand and eighty Hertz) is the eighteenth harmonic of the local power frequency, and the system operating frequency third harmonic (sixteen hundred and twenty Hertz) is the twenty-seventh harmonic of the local power frequency. This characteristic and condition are undesirable, since conventional filtering techniques cannot be used to isolate the system harmonic signal from the electronic noise (local power harmonic noise). Thus, although channel 118 reduces the power line harmonics that are static signals, some electronic equipment emits noise which is dynamic, such as printers. The noise characteristics are such that they are still harmonics of the local power frequency, but the signals are dynamic and will pass through channel 118.

This leads to another basis for permitting such increased antenna size and powering thereof, without adverse effect. Such additional basis is the recognition of having the system operating frequency synchronized to the local power frequency in the time domain, but not in the frequency domain. If this is implemented, channel 118 can be used to reduce the interference from metal and electronic noise that is continuously periodic. With the second and third system operating frequency harmonics asynchronous with the corresponding local power frequency harmonics in the frequency domain, conventional filtering techniques can be used to further reduce the interference from electronic noise that is dynamic.

Returning again to channel 116 of FIG. 6, the frequency of signals on line 138 is N times the local power frequency. Divider 140 divides down by M, with the result that the system operating frequency is now N/M times the local power frequency.

If N/M is an integer, the performance characteristic is undesirable, i.e., the same as described above. Thus, all system operating frequency harmonics will be synchronous with the local power frequency in the frequency domain. If N/M is not an integer, then most of the harmonics of the system operating frequency will not be an integral multiple of the local power frequency. If N/M is a reduced fraction, then only the system operating frequency harmonics which are integral multiples of M will be synchronous with the local power frequency harmonics. Conversely, all system operating frequency harmonics which are not integral multiples of M will of necessity evade synchronism with the local power frequency.

With this analysis, it will be appreciated that the value of M need be set only to the next higher integer to the highest integer harmonic used as a basis of EAS tag detection. In the known system under discussion wherein the second and third harmonics of the system operating frequency are used in tag detection, M can thus have the value of four or more.

Figure 7:
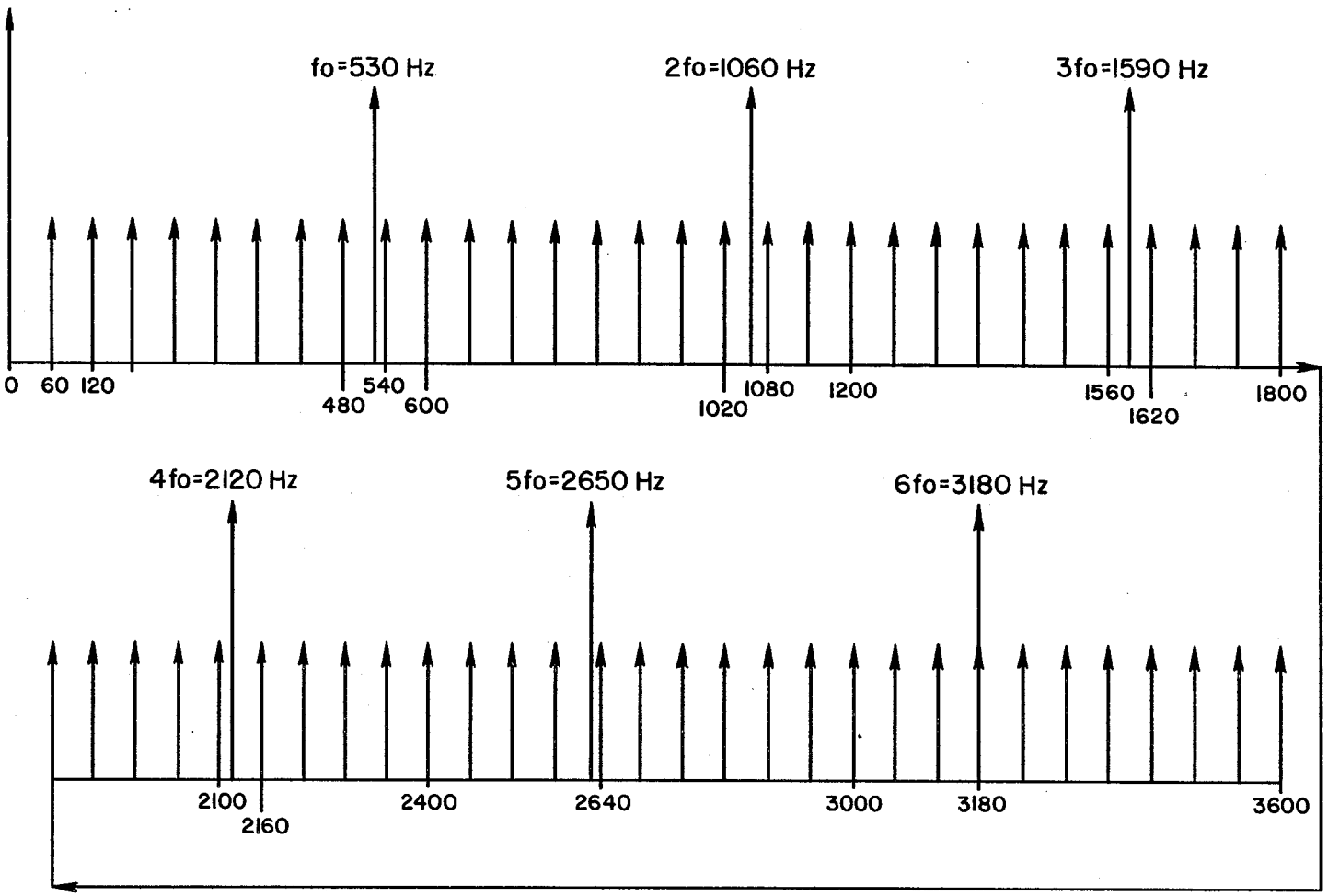
FIG. 7 is a frequency domain graphical showing helpful in understanding the invention.

FIG. 7 shows a frequency spectrum of all sixty Hertz local power fundamental and harmonics up to thirty-six hundred. A system operating frequency fundamental $f_o$ and harmonics thereof up to the sixth harmonic are superimposed on the local power frequency indications. The figure shows that the second, third, fourth and fifth system operating frequency harmonics are all asynchronous with the local power frequency harmonics, M being six in this instance (N=53). With M so set, the sixth harmonic is the first system operating harmonic which is in synchronism with a local power frequency harmonic (the fifty-third local power frequency harmonic).

Returning again to the setting of the delay period in channel 118 in relation to the period of the local power frequency, the delay time need be an integral multiple of the local power frequency period, wherein the minimum such multiple need be M. Such multiple may of course be any integral multiple of M.

In summary of the above example, the operating system parameters for the first embodiment are local power frequency at sixty Hertz, system operating frequency at five hundred and thirty Hertz, M at 6 and N at 53.

Figure 8:
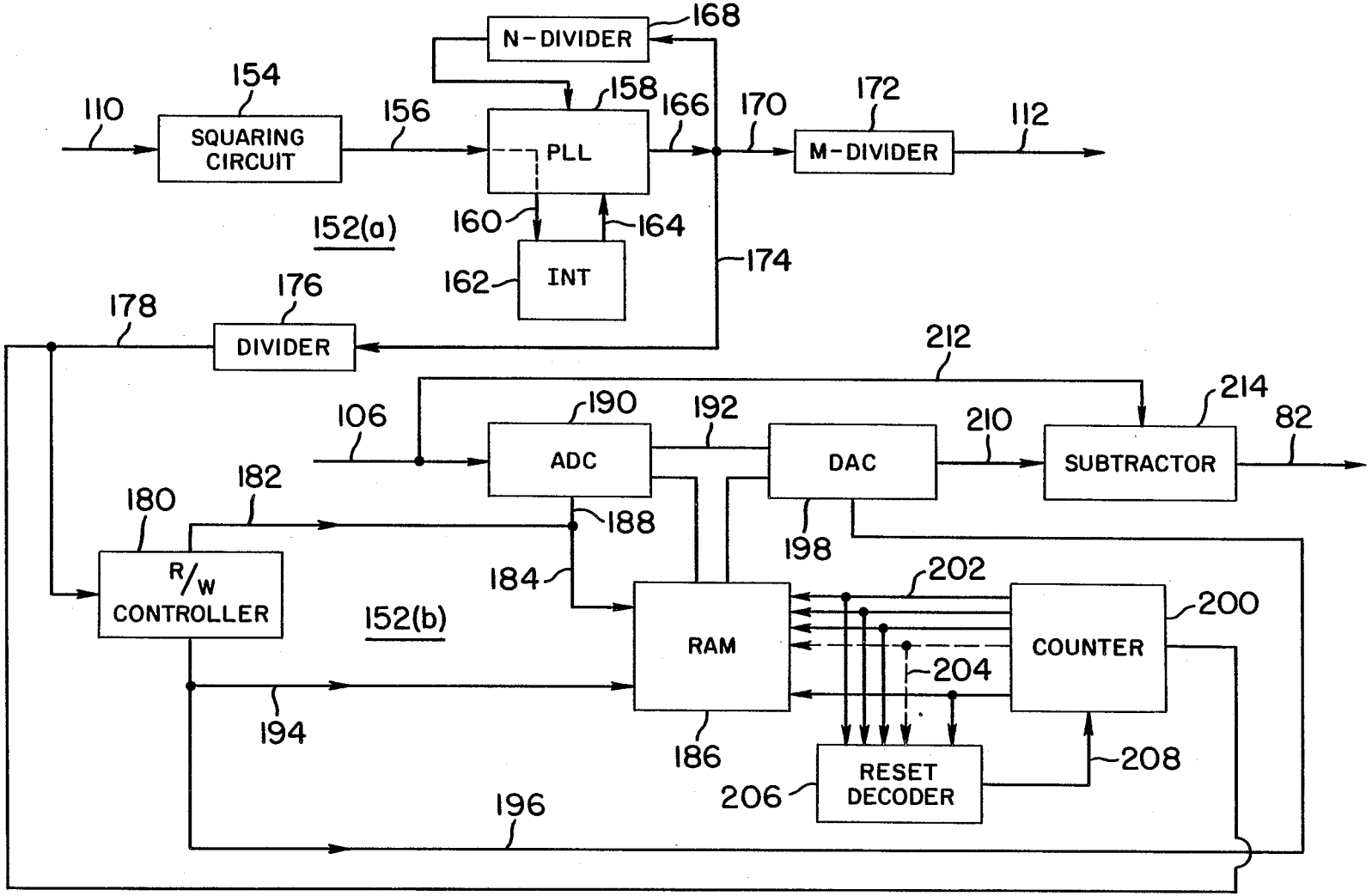
FIG. 8 is a block diagram of a further embodiment of the system of the invention.

FIG. 8 depicts an embodiment of the system of the invention wherein the signal processing with delay is effected by digital circuitry. Upper and lower channels 152(*a*) and 152(*b*) are provided for respective system operating frequency control and comb filter delay control.

Channel 152(*a*) has the local power frequency indication provided as an input on line 110, with such sine wave being squared by squaring circuit 154. The squared signal is applied over line 156 to PLL (phase-locked loop) 158, the PLL conducting the signal therethrough, as indicated by the broken routing lines in FIG. 8, over line 160 to integrator (INT) 162. The integrated signal is supplied as a d.c. level over line 164 to the voltage-controlled oscillator and the output is furnished on line 166 to be divided down in frequency by N-divider 168 and then applied as an input to the VCO.

Line 170 conveys the VCO output to M-divider 172, the output of which is provided to line 112 as the system operating frequency.

Line 174 conveys the VCO output to divider 176 to establish clock signals over line 178 to read/write (R/W) controller 180 and counter 200. Write signals are provided by controller 180 on line 182 and over line 184 to random-access memory (RAM) 186 and over line 188 to analog-to-digital converter (ADC) 190. A data bus is indicated at 192. Read signals are furnished by controller 180 over lines 194 and 196 to RAM 186 and digital-to-analog converter (DAC) 198, respectively. Counter 200 is associated with RAM 186 for address definition and supplies its counting state output to the RAM over lines 202. Lines 202 are further connected by lines 204 to reset decoder 206, which resets counter 200 by clearing input thereto over line 208.

Signals issuing from D/A converter 198 on line 210 are delayed precisely by the delay time period and are combined subtractively with the present analog received signal on line 212 in subtractor 214, with the result of the signal processing applied to line 82 for further processing in the receiver of the FIG. 4 system.

Figure 9:
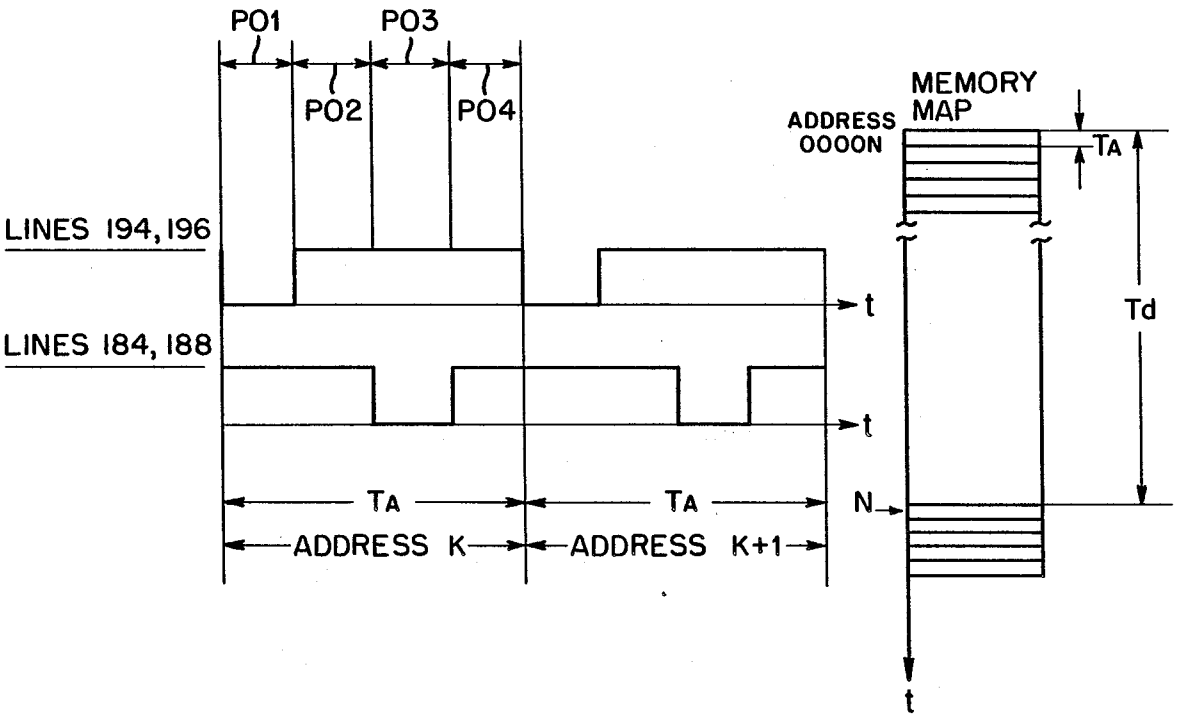
FIG. 9 is a timing diagram applicable to the FIG. 8 system.

The timing of the write and read signals will be seen by reference to FIG. 9. Each address period ($T_A$) is divided into four equal portions, a first portion (PO1) for reading, a second portion (PO2) defining a high impedance state, a third portion (PO3) for writing and a fourth portion (PO4) also defining a high impedance state.

Reconstruction of the delayed input signal begins for address K with reading the data which was stored in RAM one time period earlier and sending it to converter 198. A read pulse from the controller enables the RAM's output enable and the converter's select simultaneously. Data from the RAM is placed on the data bus and into the converter and is immediately converted into an analog value. A read pulse occupies one-fourth (PO1) of the address period and during this time, the output buffer of converter 190 is disabled. In the ensuing second portion (PO2) of the address period, the high impedance state, the converters and the RAM are all disabled and no data is placed on the data bus. During the third portion (PO3) of the address period, the write signal enables the converter 190 and the RAM's write entry input simultaneously. While the write signal is true, the converter samples the analog received signal and converts it into a digital signal, the speed of the conversion being chosen to attain completion of the conversion by the end of the write period. This data is placed on the data bus and is written into the RAM on the rising edge of the write signal. The fourth portion (PO4) of the address period has the same effect as the second portion, disabling the converters and the RAM and freeing the data bus of data content. At the close of the fourth portion of the address period, the counter is incremented to the next RAM address (K+1).

In FIG. 9, $T_A$ is the address period with corresponding indications being provided on both the timing signal waveform and the MEMORY MAP. The sampling rate of the converters is the inverse of the address period. $T_d$ is the full delay time period. When the counter reaches state of count N, at the close of the fourth portion of that address period, the reset decoder generates the counter reset pulse and the process repeats. Incrementing through the RAM's addresses reproduces the delayed waveforms.

Various changes to the foregoing embodiments and practices of the invention may evidently be changed without departing from the invention. Thus, while the invention has been described in detail in connection with the interference at hand being ascribed to the local power frequency in an EAS system, it will be apparent that the interference source can otherwise exist and be accommodated for in EAS or other systems. Thus, in practice in accordance with the invention, the interfering signal of consequence is replicated within the rejection circuitry, if not available directly as in the case of the power source frequency. Practice proceeds as above discussed, i.e., indication of the interfering frequency being provided and time period and transmitting frequency being established therefrom. Accordingly, it is to be understood that the particularly disclosed and described preferred embodiments and practices are intended in an illustrative and not in a limiting sense. The true spirit and scope of the invention is set forth in the ensuing claims.

What is claimed is:

1. In combination, in a system for receiving input signals having content of a first frequency of interest in the background of content of a second frequency of interfering nature, and for processing said input signals:

(a) first circuit means for providing an identifier signal indicative of said second frequency;

(b) second circuit means for receiving said input signals, for delaying said input signals for a time period, and for combining said input signals and such delayed input signals; and (c) third circuit means responsive to said identifier signals for establishing said time period for said second circuit means.

2. The invention claimed in claim 1 wherein said system includes a transmitter for issuing signals giving rise to such received input signals, and wherein said third circuit means further controls the frequency of transmission of said transmitter responsively to said identifier signals.

3. The invention claimed in claim 1 wherein said third circuit means includes frequency-control circuitry having an output terminal and first and second input terminals, said first input terminal receiving said identifier signals, said frequency-control circuitry including a first frequency divider connecting said output terminal thereof to said second input terminal thereof.

4. The invention claimed in claim 3 wherein said first frequency divider has a divider value which is an integral multiple of said second frequency.

5. The invention claimed in claim 4 wherein said third circuit means further includes a second frequency divider connected to said frequency-control circuitry output terminal and having a divider value for use in establishing said first frequency.

6. The invention claimed in claim 5 wherein said third circuit means further includes a third frequency divider connected to said frequency-control circuitry output terminal and having a divider value establishing said time period.

7. The invention claimed in claim 1 wherein said second circuit means includes an analog-to-digital converter (ADC) means for receiving and converting said input signals to provide ADC output signals, memory means for storing said ADC output signals, digital-to-analog converter (DAC) means for receiving and converting signals stored by said memory means and thereby furnished to said DAC means to provide DAC output signals, and control means responsive to signals output by said third circuit means for operating both of said converter means and said memory means.

8. The invention claimed in claim 7 wherein said control means applies first concurrent control signals to said analog-to-digital converter means and to a write input of said memory means and second concurrent control signals time-spaced from said first concurrent control signals to said digital-to-analog converter means and to a read input of said memory means.

9. The invention claimed in claim 8 wherein said control means includes counter means incremented by said signals output by said third circuit means and effecting addressing of said memory means for such storing of signals and furnishing of stored signals.

10. The invention claimed in claim 9 wherein said control means includes reset means connected to said counter means for cycling said counter means.

11. The invention claimed in claim 10 wherein said second circuit means includes subtractor means receiving said input signals and DAC output signals for effecting said combining to provide said processed signals.

12. A system for processing signals returned from objects in the vicinity of a controlled zone responsively to incidence thereon of signals transmitted therein at a first frequency by a transmitter supplied with local power at a second frequency, said system comprising:

(a) first circuit means for receiving such returned signals, delaying said returned signals for a time period, and combining said returned signals and such delayed returned signals to provide such processed signals; and (b) second circuit means responsive to signals indicative of said second frequency for establishing both said time period for said first circuitry and said first frequency for said transmitter.

13. The invention claimed in claim 12 wherein said second circuit means includes frequency-control circuitry having an output terminal and first and second input terminals, said first input terminal receiving said signals indicative of said second frequency, said frequency-control circuitry including a first frequency divider connecting said output terminal thereof to said second input terminal thereof.

14. The invention claimed in claim 13 wherein said first frequency divider has a divider value which is an integral multiple of said second frequency.

15. The invention claimed in claim 14 wherein said second circuit means further includes a second frequency divider connected to said frequency-control circuitry output terminal and having a divider value for use in establishing said first frequency.

16. The invention claimed in claim 15 wherein said second circuit means further includes a third frequency divider connected to said frequency-control circuitry output terminal and having a divider value establishing said time period.

17. The invention claimed in claim 12 wherein said second circuit means has an output terminal and includes a first frequency divider connected to said output terminal and having a divider value usable in establishing said time period.

18. The invention claimed in claim 17 wherein said second circuit means includes frequency-control circuitry having said signals indicative of said second frequency as an input thereto.

19. The invention claimed in claim 18 wherein said frequency-control circuitry has an output terminal and first and second input terminals, said first input terminal receiving said signals indicative of said second frequency, said frequency-control circuitry including a second frequency divider connecting said output terminal thereof to said second input terminal thereof, said output terminal of said frequency-control circuitry being connected to said first frequency divider.

20. The invention claimed in claim 19 wherein said second frequency divider has a divider value which is an integral multiple of said second frequency.

21. The invention claimed in claim 20 wherein said second circuit means further includes a third frequency divider connected to said frequency-control circuitry output terminal and having a divider value for use in establishing said first frequency.

22. The invention claimed in claim 21 wherein said first circuit means includes an analog-to-digital converter (ADC) means for receiving and converting said returned signals to provide ADC output signals, memory means for storing said ADC output signals, digital-to-analog converter (DAC) means for receiving and converting signals stored by said memory means to provide DAC output signals, and control means responsive to signals output by said second circuit means for operating both of said converter means and said memory means.

23. The invention claimed in claim 22 wherein said control means applies first concurrent control signals to said analog-to-digital converter means and to a write input of said memory means and second concurrent control signals time-spaced from said first concurrent control signals to said digital-to-analog converter means and to a read input of said memory means.

24. The invention claimed in claim 22 wherein said control means includes counter means incremented by said signals output by said second circuit means and effecting addressing of said memory means for such storing of signals and furnishing of stored signals.

25. The invention claimed in claim 24 wherein said control means includes reset means connected to said counter means for cycling said counter means.

26. The invention claimed in claim 22 wherein said first circuit means includes subtractor means receiving said returned signals and DAC output signals for effecting said combining to provide said processed signals.

27. The invention claimed in claim 22 wherein said second circuit means includes frequency-control circuitry having said signals indicative of said second frequency as an input thereto.

28. The invention claimed in claim 27 wherein said frequency-control circuitry has an output terminal and first and second input terminals, said first input terminal receiving said signals indicative of said second frequency, said frequency-control circuitry including a first frequency divider connecting said output terminal thereof to said second input terminal thereof.

29. The invention claimed in claim 28 wherein said first frequency divider has a divider value which is an integral multiple of said second frequency.

30. The invention claimed in claim 29 wherein said second circuit means further includes a second frequency divider connected to said frequency-control circuitry output terminal and having a divider value for use in establishing said first frequency.

31. The invention claimed in claim 30 wherein said second circuit means further includes a third frequency divider connected to said frequency-control circuitry output terminal and having a divider value establishing said time period.

32. In a method for EAS detection of EAS tags by the use of locally available electrical power, the steps of:

(a) establishing first signals at a frequency of N, where N is an integral multiple of the frequency of said locally available electrical power;

(b) establishing second signals at a frequency of N/M, where M is an integer less than N and transmitting said second signals into a zone to be subjected to EAS detection;

(c) receiving signals comprising returns responsive to such transmission in said zone from EAS tags and other objects therein;

(d) delaying such received signals by a period related to the period of said locally available electrical power to provide delayed received signals; and (e) combining said received signals with said delayed received signals.

33. In a method for EAS detection of EAS tags by the use of locally available electrical power to effect signal transmission into a controlled zone, the steps of:

(a) interrelating the frequency of the transmitted signals to the local power frequency in predetermined manner;

(b) receiving signals returned from EAS tags and other objects in said zone responsively to the transmitted signals;

(c) processing such received signals by delaying the same by a time delay related to said local power frequency and combining received signals and delayed received signals.

34. The invention claimed in claim 33 wherein said step (a) is practiced in part by effecting a frequency domain asynchronism as between selected harmonics of said frequency of the transmitted signals and said local power frequency.

35. The invention claimed in claim 34 wherein said step (b) is practiced in part by effecting a time domain synchronism as between received signals and said local power frequency.

36. The invention claimed in claim 33 wherein said step (b) is practiced in part by effecting a time domain synchronism as between received signals and said local power frequency.

37. In combination:

(a) a system for processing signals returned from objects in the vicinity of a controlled zone responsively to incidence thereon of signals transmitted therein at a first frequency by a transmitter supplied with local power at a second frequency, said system comprising:

(1) first circuit means for receiving such returned signals, delaying said returned signals for a time period, and combining said returned signals and such delayed returned signals to provide such processed signals:

(2) second circuit means responsive to signals indicative of said second frequency for establishing both said time period for said first circuitry and said first frequency for said transmitter;

(b) receiver means for receiving said processed signals and for examining the same for harmonic content related to said first frequency and generating an alarm activating output signal upon detection of preselected such harmonic content in said processed signals; and (c) alarm means responsive to said alarm activating output signal to provide alarm indication.

38. The invention claimed in claim 37 wherein said second circuit means includes frequency-control circuitry having said signals indicative of said second frequency as an input thereto.

39. The invention claimed in claim 38 wherein said frequency-control circuitry has an output terminal and first and second input terminals, said first input terminal receiving said signals indicative of said second frequency, said frequency-control circuitry including a first frequency divider connecting said output terminal thereof to said second input terminal thereof.

40. The invention claimed in claim 39 wherein said first frequency divider has a divider value which is an integral multiple of said second frequency.

41. The invention claimed in claim 40 wherein said second circuit means further includes a second frequency divider connected to said frequency-control circuitry output terminal and having a divider value for use in establishing said first frequency.

42. The invention claimed in claim 41 wherein said second circuit means further includes a third frequency divider connected to said frequency-control circuitry output terminal and having a divider value establishing said time period.

43. A method for EAS detection of EAS tags by the use of locally available electrical power, comprising the steps of:

(a) establishing first signals at a frequency of N, where N is an integral multiple of the frequency of said locally available electrical power;

(b) establishing second signals at a frequency of N/M, where M is an integer less than N and transmitting said second signals into a zone to be subjected to EAS detection;

(c) receiving signals comprising returns responsive to such transmission in said zone from EAS tags and other objects therein;

(d) delaying such received signals by a period related to the period of said locally available electrical power to provide delayed received signals;

(e) combining said received signals with said delayed received signals to provide processed signals; and (f) examining said processed signals for harmonic content related to said first frequency and generating an alarm activating output signal upon detection of preselected harmonic content in said processed signals.

44. A method for EAS detection of EAS tags by the use of locally available electrical power to effect signal transmission into a controlled zone, comprising the steps of:

(a) interrelating the frequency of the transmitted signals to the local power frequency in predetermined manner;

(b) receiving signals returned from EAS tags and other objects in said zone responsively to the transmitted signals;

(c) processing such received signals by delaying the same by a time delay related to said local power frequency and combining received signals and delayed received signals to provide processed signals; and (d) examining said processed signals for harmonic content related to said first frequency and generating an alarm activating output signal upon detection of preselected harmonic content in said processed signals.

45. The invention claimed in claim 44 wherein said step (a) is practiced in part by effecting a frequency domain asynchronism as between selected harmonics of said frequency of the transmitted signals and said local power frequency.

46. The invention claimed in claim 45 wherein said step (b) is practiced in part by effecting a time domain synchronism as between received signals and said local power frequency.

47. The invention claimed in claim 44 wherein said step (b) is practiced in part by effecting a time domain synchronism as between received signals and said local power frequency.

* * * * *